United States Patent [19]

Hooper, Jr.

[11] 3,988,555

[45] Oct. 26, 1976

[54] CAM OPERATED SWITCH

[75] Inventor: Dean Roosevelt Hooper, Jr., Middletown, Pa.

[73] Assignee: AMP Incorporated, Harrisburg, Pa.

[22] Filed: June 20, 1975

[21] Appl. No.: 588,934

[52] U.S. Cl. ..... 200/153 LB; 200/155 R; 200/6 BB

[51] Int. Cl.[2] ..... H01H 19/28

[58] Field of Search ..... 200/153 LB, 155 R, 6 BB, 200/6 B

[56] References Cited

UNITED STATES PATENTS 506,841 10/1893 Bulen ..... 200/6 BB 3,715,545 2/1973 Long ..... 200/6 BB

*Primary Examiner*—Herman Hohauser

*Attorney, Agent, or Firm*—Allan B Osborne

[57] ABSTRACT

The present invention relates to a single pole, single throw switch and more particularly to a switch having a redundancy of opposing contacts which are cammed into or out of engagement by a cam positioned between the contacts. The switch consists of a molded housing, molded cam means and two identical conductive means stamped and formed from flat metal stock. Preload cantilever beams provide biasing forces for the contacts.

9 Claims, 5 Drawing Figures

CAM OPERATED SWITCH

BACKGROUND OF THE INVENTION

Switches are available in hundreds of different varieties and for as many uses. However, switches that are printed circuit board mounted and which are capable of carrying high currents are limited. Those that can carry high currents are expensive and generally large. Small switches which lend themselves to printed circuit board applications are generally capable of handling signal level currents only; e.g. relay switches.

Switch reliability is an important factor, i.e., highly reliable switches are generally expensive while inexpensive switches have a short useful life.

Switches which are printed circuit board compatible are so small that the contact condition (off-on) legend is either not present or is so small that it is difficult to read casually.

Switches currently on the market contain a large number of parts and are therefore expensive to make and assemble.

Accordingly, an object of the present invention is to provide a small switch which can be used on a printed circuit board and which is capable of carrying high currents and high voltages.

Another object of the present invention is to provide a switch which can switch high currents and is reliable.

Still another object of the present invention is to provide a switch having visible contact mode.

Yet another object of the present invention is to provide a switch having redundant contacts.

Another object of the present invention is to provide a switch that has only four components and is economical to manufacture and assemble.

These and other objects and advantages of the present invention will become readily apparent from the following description.

DESCRIPTION OF THE PREFERRED EMBODIMENT

Figure 1:
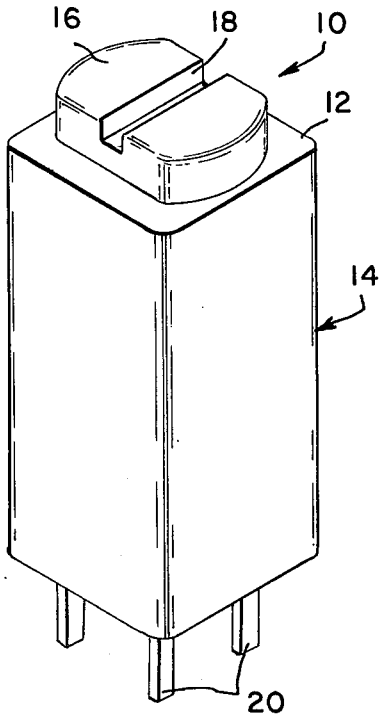
FIG. 1 is a perspective view of an assembled switch constructed in accordance with the present invention.

FIG. 1 illustrates the assembled switch 10 ready to be plugged onto an electrical circuit (not shown) such as on a printed circuit board. The top surface 12 of housing 14 may have the "off-on" legend inscribed thereon as shown. The shape of actuator 16 which is rotatably positioned overlying surface 12 is narrow in one direction so that its positioning exposes the condition of the contacts within the switch. The screwdriver-receiving slot 18 cutting across the top of the actuator is also orientated so as to point to the contact condition. Four pins 20, three of which are seen in the figure, depend from housing 14 and are pluggable into the circuit such as found on a printed circuit board.

Figure 2:
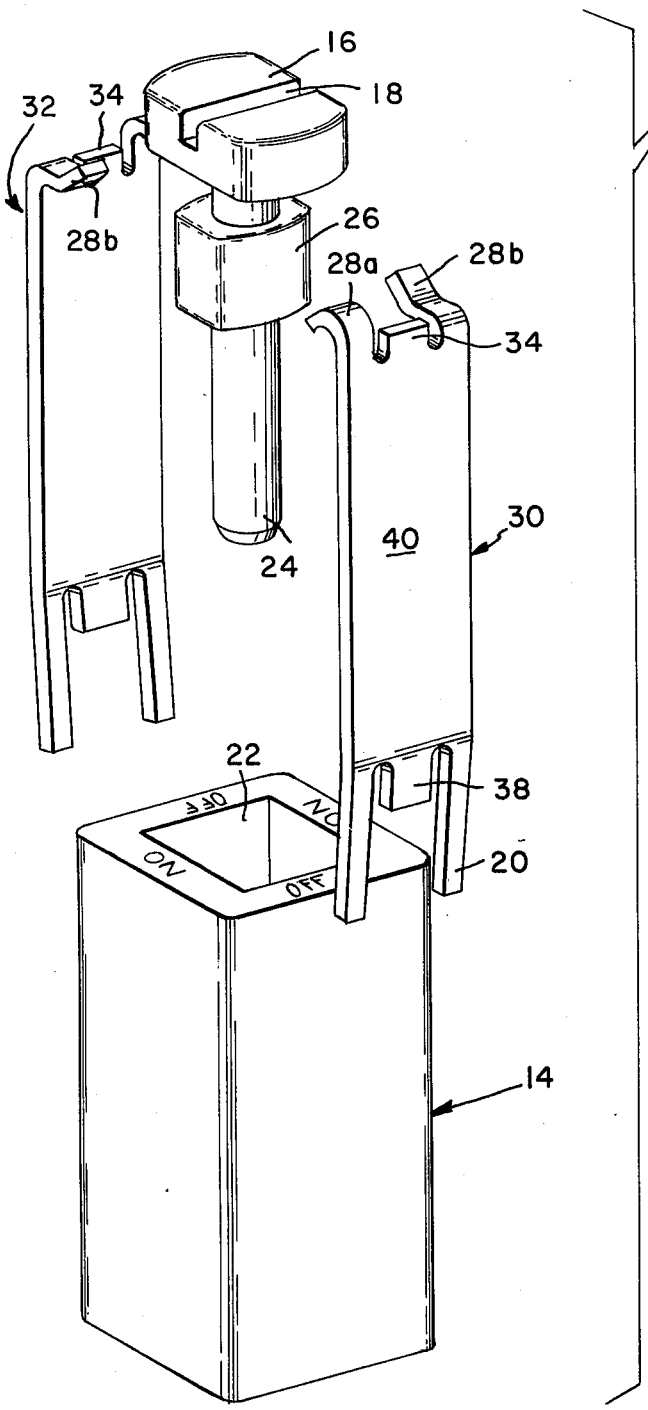
FIG. 2 is an exploded view of the switch of FIG. 1.

FIG. 2 is a view of switch 10 exploded so that the several elements can be seen. The housing has a central opening 22 which will be described with reference to FIG. 3.

Actuator 16 sits on top of an elongated shaft 24 on which is an eccentric upset or cam 26. The lower end 28 of the shaft is beveled to facilitate insertion and rotation in housing 14.

The cam is generally elongated with squared ends so that the contact mode changes with each quarter turn of the actuator. As is well known in the art however, the cam can be so designed as to possess lobes such that the contact mode changes with a desired amount of rotation. The governing or limiting parameter which must be considered in the design is size and the desired distance between the contacts when open.

The subassembly consisting of shaft 24, actuator 16 and cam 26 constitutes the cam means 27 of switch 10.

Figure 5:
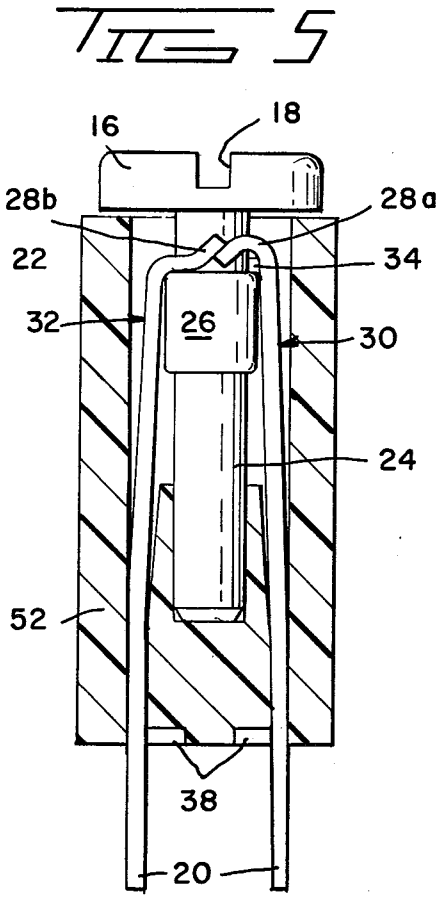
FIGS. 4 and 5 are elevational cross-sectional views of the switch of FIG. 1 showing the operation of the camactuated contacts as well as assembly detail.

Contacts 28, to which reference has been made above, are two laterally projecting tabs **28*a* and 28*b* positioned on top of identical lead frames 30 and 32. Contacts 28*a* are rounded over so that the free ends point obliquely downwardly. Contacts 28*b* are bent or formed obliquely upwardly. The lead frames are stacked into housing 14 so that the contacts face each other and when in a closed condition, as seen in FIG. 5, contact 28*b* on lead frame 32 engages contact 28*a* on frame 30**. The angularity of the free ends of the opposing contacts are such as to cause the flat surfaces to slide across each other for an appreciable distance. This frictional engagement wipes dirt and corrosion from the surfaces and provides clean electrical contact surfaces.

Figure 4:
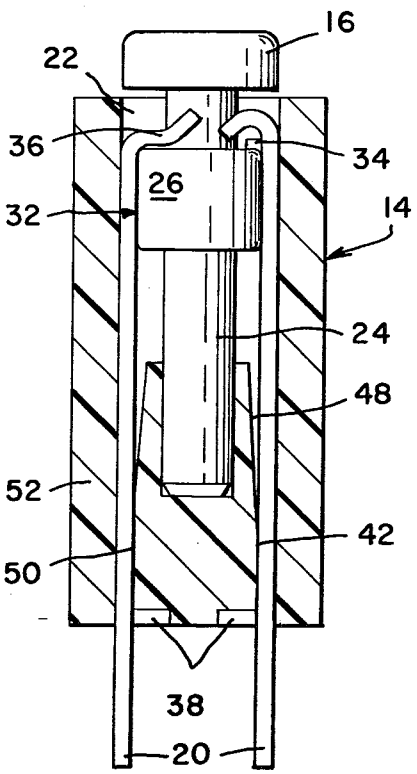

A short center locking tab 34, located between contacts **28*a* and 28*b* on top of frames 30 and 32, may be bent inwardly 90° to rest on top of cam 26 in the assembled switch. This provides one means for retaining the cam means within housing 14. Another means for doing the same thing is shown in FIGS. 4 and 5. Note that contacts 28*b* have a flat surface 36** which can, by design, offer a stop to keep the cam means from sliding out of the housing.

The other end of frames 30 and 32 contain the aforementioned pins 20. The shape of these pins can be changed to make the switch pluggable into any type of electrical circuit.

A second short center locking tab 38, located between pins 20 on each frame 30 and 32, are bent inwardly ninety degrees after the frames are stacked into the housing. This provides a means for locking the frames into the housing.

The portion of lead frames 30 and 32 lying between the contacts 28 and pins 20 provide a cantilever beam 40. The frames are bent or deformed inwardly relative to pins 20 as shown in FIGS. 2 and 5. Thus, in the assembled switch the non-stressed condition is one which biases contacts 28 against each other (FIG. 5).

Lead frames 30 and 32 provide conductive means 41 for the switch; i.e., current entering one lead frame via pins 20 may cross over to the second frame via the contacts and out into another circuit via the pins on the second frame. Although the switch may contain a single contact on each frame; e.g., contact **28*a* on frame 30 and contact 28*b* on frame 32, the redundancy of contacts increase the effectiveness and reliability of the switch. Likewise, the pins could be reduced to one per frame; again, redundancy enhances its reliability and therefore, the best mode of the present invention. Whereas any conductive material can be used in forming lead frames 30 and 32, a preferred material is a cooper alloy with a tin plating. The non-noble plating is possible because the preloaded cantilever beams 40** provide sufficient force to insure reliable electrical contact.

Figure 3:
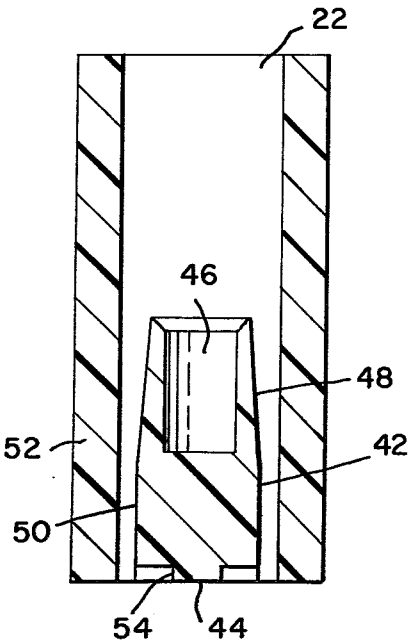
FIG. 3 is an elevational cross-section of the housing of the switch shown in FIG. 1.

FIG. 3 is a cross-sectional view of housing 14 showing its internal construction. A shaft-receiving supporting post 42 juts up from the base 44 of the housing and contains socket 46 into which the lower end of shaft 24 rotatably fits. The mouth of the socket may be beveled inwardly to facilitate the insertion of the shaft therein during assembly. For this reason the end of the shaft is also beveled. The outer surfaces of walls 48 defining the socket are tapered inwardly in an upwardly direction to provide clearance for the cantilever beams 40 when the contacts 28 are closed (FIG. 5). The lower surfaces 50 of post 42 flare out to narrow the space between it and walls 52 of housing 14. The space is sufficient only to allow the lead frame to pass through with difficulty. The bottom of the post have notches 54 to receive locking tabs 38 as shown in FIGS. 4 and 5.

The post, being integral with the housing, merges into and becomes part of its base. The opening 22 narrows down and splits into two branches through which the pins 20 and tabs 38 pass.

Switch 10 has three basic parts: housing 14, two identical lead frames 30 and 32 and cam means 27. The housing and cam means can be molded from non-conductive, glass filled nylon and the frames stamped and fromed from conductive, flat stock copper alloy. It is apparent that the present invention provides a economical switch with a high degree of reliability. Further, assembly requires only the staking of the frames and cam means into the housing. FIGS. 2, 4 and 5 illustrate the simplicity associated with the switch of the present invention.

FIGS. 4 and 5 also illustrate the open and closed modes of switch 10. In FIG. 4, cam 26 has been turned to spread the contacts 28 apart into the open condition. FIG. 5 shows the actuator turned ninety degrees so that the long direction of cam 26 parallels the width of frames 30 and 32. Without the interference of the cam the preloaded cantilever beams 40 biases the contacts 28 together into the closed condition.

Although not shown, switch 10 can be made in multiples; i.e., a bank of housings 14 molded in a one-shot operation with individual cam means 27 and conductive means 41 for each housing. Other variations of the basic switch concept can provide specialized switch assemblies for particular uses.

The physical dimensions of switch 10 can vary without departing from the teaching of the present invention. Current carrying capabilities of course do relate to the material and size of the conductive means which in turn dictate the size of the other two components of the switch. Using tin plated, copper alloy contacts, lead frames having a cantilever beam length of 0.5 inches and width of 0.120 inches provide a current rating of two amps at 120 volts. The switch for these frames have a height of 0.595 inches, with the square housing being 0.245 inches on a side. Pin spread is 0.120 inch on center between pins on the same frame with a 0.140 inch on center spread between opposing pins.

The foregoing detailed discription has been given for clearness of understanding only, and no unnecessary limitations should be understood therefrom, as some modifications will be obvious to those skilled in the art.

What is claimed is:

1. A switch which comprises:

a. a housing having an opening;

b. a pair of preloaded cantilever beams with each being positioned along an opposing side of the opening and adapted to bias the upper end inwardly toward the opening, each having at the upper end a contact tab extending inwardly toward the opposing contact tab, and further having at the lower end at least one depending pin adapted to be plugged into an electrical circuit or the like; and c. cam means rotatably positioned in the opening between the cantilever beams and adapted to cam the contact tabs into or out of engagement.

2. The contact means of claim 1 wherein each cantilever beam contains a plurality of tabs, the tabs on one beam opposing the tabs on the other beam.

3. The contact means of claim 2 wherein the free end of each tab extends obliquely away from the obliquely extending free end of the opposing tab.

4. A switch comprising:

a. an elongated, non-conductive housing having a central opening in the upper portion thereof, and having a support post extending upwardly from the base into the central opening, and further having one or more passages along two opposite sides of the post extending from the base of the housing to the central opening;

b. a pair of generally flat, elongated, conductive lead frames each staked in the housing along opposite sides of the central opening, each frame having one or more pins extending from the lower end thereof through the passages and depending downwardly from the base of the housing, and further having a contact at each of the two corners at the upper end thereof and projecting laterally across the central opening toward and removably engageable with a contact on the opposing lead frame; and c. an elongated, non-conductive shaft rotatably positioned in the central opening with its lower end resting on the support post, said shaft having a cam positioned thereon which is engageable with the opposing lead frames so that as the shaft is rotated, the cam either separates the contacts or permits the contacts to engage, said shaft further having an actuator thereon extending above the top of the housing and which provides means for rotating the shaft.

5. The switch of claim 4 wherein the support post includes an upwardly opening socket which receives the lower end of the shaft.

6. The switch of claim 4 wherein each lead frame further includes a tab on the upper end bent inwardly over the cam thereby securing the shaft to the housing.

7. The switch of claim 4 wherein each lead frame further includes a tab on the lower end bent inwardly against the base of the housing thereby securing said frame against upward travel.

8. The switch of claim 4 wherein each lead frame is bent intermediate the lower and upper ends thereby placing said frames in a preloaded condition in the central opening of the housing so that the lead frames bias opposing contacts toward each other.

9. The switch of claim 4 wherein the contact on one corner of one lead frame is formed to extend obliquely downwardly and the opposing contact on the other lead frame is formed to extend obliquely upwardly so that when the opposing contacts are in engagement the upper surface of one bears against the lower surface of the other.

* * * * *